US010488138B2

(12) United States Patent
Johansen et al.

(10) Patent No.: US 10,488,138 B2
(45) Date of Patent: Nov. 26, 2019

(54) SILENCER FOR A SHOTGUN

(71) Applicant: A-TEC HOLDING AS, Son (NO)

(72) Inventors: Anders Eckhoff Johansen, Son (NO); Hallvard Winterseth, Saltnes (NO)

(73) Assignee: A-Tec Holding AS, Son (NO)

( * ) Notice: Subject to any disclaimer, the term of this patent is extended or adjusted under 35 U.S.C. 154(b) by 0 days.

(21) Appl. No.: 15/936,479

(22) Filed: Mar. 27, 2018

(65) Prior Publication Data

US 2018/0283822 A1 Oct. 4, 2018

(30) Foreign Application Priority Data

Mar. 30, 2017 (NO) ..... 20170530

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/40; F41A 21/44; F41A 21/325; F41A 21/34
See application file for complete search history.

(56) References Cited

U.S. PATENT DOCUMENTS

D594,082 S * 6/2009 O'Quinn ..... F41A 21/30 D22/108
D632,751 S * 2/2011 Bowers ..... D22/108
8,967,325 B1 * 3/2015 Cronhelm ..... F41A 13/00 181/223
D767,073 S * 9/2016 Dulisse ..... D22/108
D769,395 S * 10/2016 Dulisse ..... D22/108
D778,386 S * 2/2017 Farthing ..... D22/108
D778,387 S * 2/2017 Farthing ..... D22/108
D779,618 S * 2/2017 Farthing ..... D22/108
2005/0262997 A1 * 12/2005 Brixius ..... F41A 13/06 89/14.1
2014/0059913 A1 * 3/2014 Diamond ..... F41C 27/00 42/90
2015/0241159 A1 * 8/2015 Michal ..... F41A 21/30 89/14.4
2015/0338184 A1 11/2015 White et al.
2016/0003570 A1 * 1/2016 Tonkin ..... F41A 21/02 89/14.4
2016/0187093 A1 * 6/2016 Barrett ..... F41A 21/28 89/14.4
2016/0209150 A1 7/2016 Smith
2017/0299291 A1 * 10/2017 Spector ..... F41A 3/66

FOREIGN PATENT DOCUMENTS

EP 2653821 A1 * 10/2013 ..... F41A 21/30
NO 20150573 11/2016

* cited by examiner

*Primary Examiner* — Benjamin P Lee

(57) ABSTRACT

A silencer for a shotgun, where the silencer comprises an outer housing and an inner hollow body arranged in the outer housing, where the outer housing comprises a main part and a first and second end part connected to the main part, where the inner hollow body further is provided with a number of longitudinal elevations extending over a length of the inner hollow body and where the longitudinal elevations are arranged at a distance from each other around an inner circumference of the inner hollow body, where it between two adjacent longitudinal elevations and over the length of the inner hollow body are provided a number of openings arranged at a distance from each other.

10 Claims, 5 Drawing Sheets

SILENCER FOR A SHOTGUN

FIELD OF THE INVENTION

The present invention relates to a silencer for a shotgun, where the silencer comprises an outer housing and an inner body arranged within the outer housing, where the silencer is provided to be connected in a releasable manner to a barrel of the shotgun, or to one or more fastening elements arranged on the barrel of the shotgun.

BACKGROUND

Silencers for firearms are well known and are usually designed for use with guns and hand guns. Many different designs and designs have been proposed for firearms that fires one projectile at a time, that is, conventional one-piece projectiles, and where the initial speeds for these are either supersonic or subsonic. With use of supersonic projectiles, the silencer must, over at least a part of its length and interior, typically be formed with a number of expansion chambers arranged after each other, so as to permit expansion of exhaust gases, thereby reducing expansion noise and often visible flame tongue from the silencer's muzzle. Such expansion chambers are usually formed with transversal baffles, where the space between the baffles will then provide the required expansion volume or the required expansion volumes in the silencer.

The throughgoing bore in the silencer, through which the projectile passes through when the firearm is fired, is somewhat larger than a largest diameter of a projectile passing through the silencer, to prevent dangerous situations from occurring, for example, by deflecting the path of the projectile. The smaller the clearance between the diameter of the throughgoing bore and the projectile is, the greater the noise suppression is achieved through the silencer. However, the noise suppression must be balanced against the production tolerances of the silencer, in order to prevent the projectile from coming into contact with the throughgoing bore.

Since a shotgun shell comprises a number of elements, such as a larger or smaller number of shots, a plastic cup or felt plug and wad, and thus can be seen as a multi-part projectile, and where these different elements will be divided from each other in a silencer, it has not been easy to design a silencer that dampens the noise efficiently.

A commonly used solution for silencers for shotguns is to use a punched cylinder to enclose the "shot column" and to surround the cylinder with a layer of a material to cause turbulence in the "enclosed" exhaust gases and to delay their release back to the cylinder after firing the shot. The shotguns deliver their projectiles and gases at supersonic speeds. Silencers designed for sonic and subsonic projectiles will therefore be less suitable for use with shotguns. Nor silencers designed with baffles are suitable for use with shotguns, as the lack of safe enclosure of pellets, plastic cup or felt plug excludes small clearance between the multi-part projectile and the throughgoing bore provided in the silencer. With a greater clearance between the multi-part projectile and the throughgoing bore, the damping will be poor.

NO 20150573 A1 relates to an module-based device for a firearm for sound direction and recoil dampening, which device is arranged for detachable fastening to a barrel of the firearm, which device includes at least one sound directing and recoil dampening module formed by a fastening device for fastening the module-based device to the barrel of the firearm and provided with means for directing/leading sound forward and away from a shooter and bystanders, and reduction for recoil and muzzle flash. The sound directing and recoil dampening module is further adapted for arrangement of at least one sound dampening module.

US 2015/241159 A1 relates to barrel and suppressor sleeves, where the suppressor sleeves and gun barrel sleeves and covers have longitudinal interior splines and venting valleys and exterior ribs arranged at angles relative to the interior splines. One or more sleeves and caps are combined to provide suppressor sleeve assemblies and gun barrel covers and related weapon accessories.

US 2015/338184 A1 relates to a sound suppressing gun barrel, where the gun barrel has a circumferential series of lands, each land among the circumferential series of lands being radially displaced from the longitudinal axis a distance at least as great as one-half of the bullet's diameter, each land extending helically about the longitudinal axis; a plurality of sound reflection chambers, each sound reflection chambers among the plurality of sound reflection chambers being positioned between an adjacent pair of lands among the circumferential series of lands, each sound reflection chamber having a muzzle end, and each sound reflection chamber opening radially inwardly; and a plurality of sound reflection walls, each wall among the plurality of sound reflection walls closing one of the sound reflection chambers' muzzle ends.

U.S. Pat. No. 8,967,325 B1 relates to a firearm sound suppressor cooling system, where the system comprises a sound suppressor housing with means for reducing the pressure of gases exiting from a discharged firearm with a shroud that is attached to the exterior of the sound suppressor housing, an annular chamber formed between the sound suppressor housing and the shroud, and a nozzle positioned at the distal end of the sound suppressor and the shroud. The nozzle produces a suction effect upon discharge of the firearm and due to the suction effect, ambient air is aspirated through the annular chamber, and cools the firearm sound suppressor.

BRIEF SUMMARY OF THE INVENTION

The present invention seeks to provide an alternate silencer which eliminates disadvantages of the prior art, and which at the same time is modular and comprises few parts.

This object is achieved according to the invention by the features set forth in the following independent claim, wherein further features of the invention appear from the dependent claims and the description below.

The present invention relates to a silencer for a shotgun, where the silencer comprising an outer housing and an inner hollow body arranged within the outer housing. The outer housing comprises a main part and a first and second end part which are suitably connected to the main body. The inner hollow body of the silencer is formed with an axial throughgoing bore and is on an inside of the axial throughgoing bore formed with a plurality of longitudinal elevations extending substantially over the entire longitudinal direction of the inner hollow body. The longitudinal elevations are disposed at a distance from each other around the entire circumference of the inner circumference of the bore, where the distance between two adjacent longitudinal elevations may be equal or different. The inner hollow body is preferably formed with an odd number of such longitudinal elevations, such as 3, 5, 7, 9, etc., but it is to be understood that the inner hollow body may be formed with an even number of such longitudinal elevations. Between two adjacent longitudinal elevations, over at least a portion of the length of the inner hollow body, a plurality of spaced apart throughgoing opening are formed, such that an inside and an outside of the inner hollow body are in communication with each other.

The spaced apart throughgoing openings may be arranged with the same distance between each other, or the throughgoing openings may be arranged in groups, where each group then may comprise the same number or different number of throughgoing openings.

The throughgoing openings may have a circular, an oval, a polygonal or a square shape. It is also conceivable that the throughgoing openings may be designed as a combination of the above shapes and the throughgoing openings may furthermore be formed with the same or different size.

The outer housing is, on an inside, provided with a plurality of spaced apart elements, each element being formed with a throughgoing hole for the leadthrough and support of the inner hollow body.

Similarly, each of the first and second end parts is formed with a throughgoing hole for reception and support of the inner hollow body when the silencer is assembled and each of the first and second end parts may further be designed with an abutting shoulder to support the main body. In one embodiment, the first end part may, around an inner circumference of the throughgoing hole, be formed with a groove for a seal member such as an O-ring or the like, so as to provide a seal between the inner hollow body and the end part when the silencer for shotguns is assembled.

In one embodiment, each of the first and second end parts may, around an outer circumference, be formed with at least one groove for a sealing member such as an O-ring or the like to provide a seal between the first and second end parts and the main part of the outer housing.

In one embodiment, the throughgoing hole provided in the one end part is formed with a threaded portion, such that the silencer can be screwed on a barrel of a shotgun.

The inner hollow body may further, on one of its sides or ends, be formed with an abutting shoulder for reception of a flange formed on the end part which is adjacent the inner hollow body when the silencer is assembled.

The main part and the first and second end parts of the outer housing are preferably made of composite materials, but a person with skill in the art will appreciate that the outer housing can also be manufactured in other materials such as metal, aluminum, etc. Furthermore, it should be understood that the various parts may be made of different materials, for example, the main part may be made of aluminum, while the end parts may be made of composite material.

Further objects, constructive embodiments and advantages of the present invention will become apparent from the following detailed description, the accompanying drawings and the following claims.

BRIEF DESCRIPTION OF THE DRAWINGS

The invention will now be explained by several non-limiting embodiments with reference to the accompanying drawings in which:

FIG. 1 shows an assembled silencer 1 for a shotgun according to the present invention, where a layer of the silencer's 1 outer housing 2 is removed in order to show an interior of the silencer 1.

DETAILED DESCRIPTION OF THE INVENTION

Figure 1:
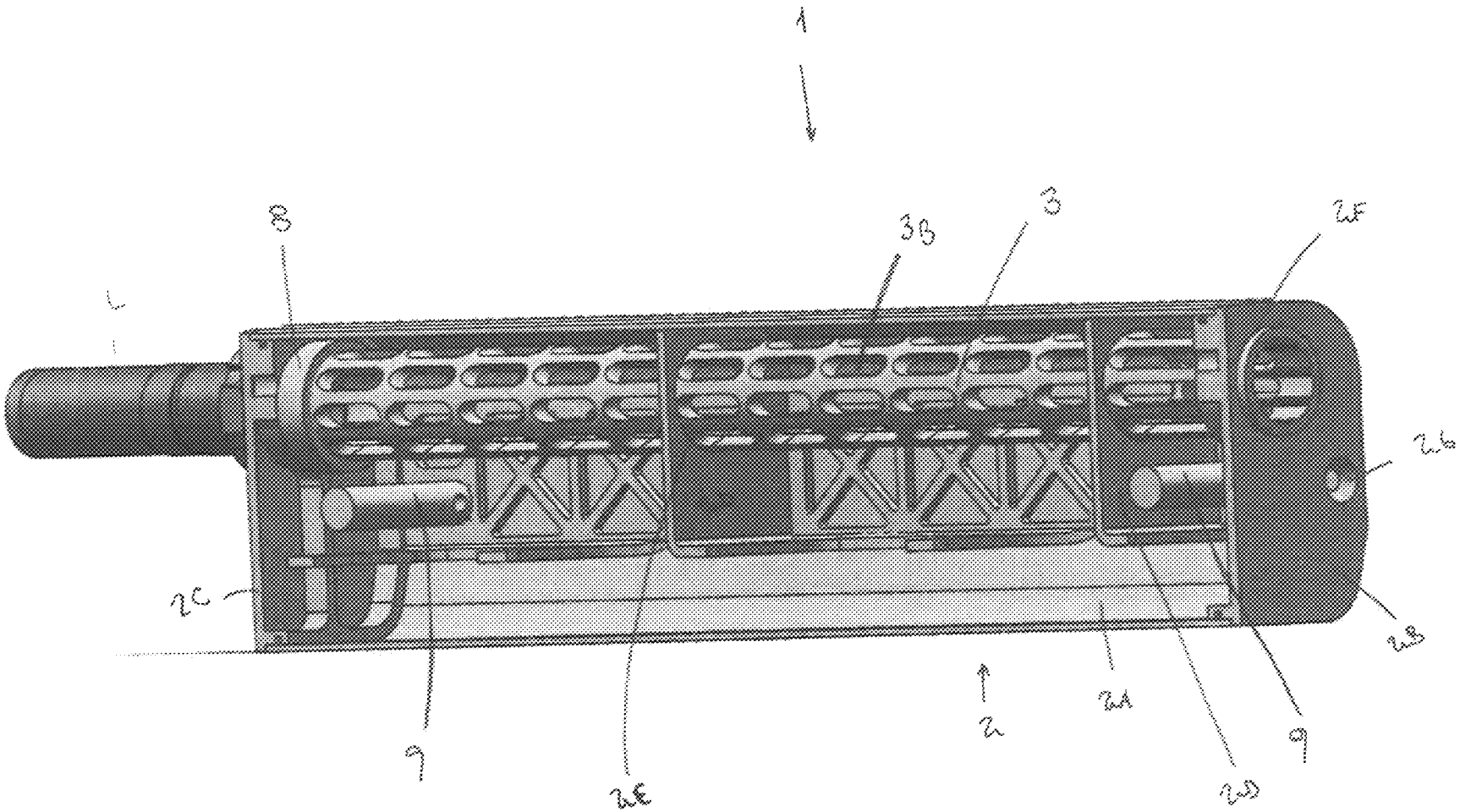
FIG. 1 shows an assembled silencer according to the present invention in partial cross section.

The silencer 1 for shotguns according to the present invention comprises an outer housing 2 and an inner hollow body 3 arranged within the outer housing 2. The outer housing 2 is formed of a main part 2A and a first and second end part 2B, 2C. Each end part 2B, 2C is formed with a hole 2G for a screw, bolt or the like, such that the first and second end part 2B, 2C can be connected with the main part 2A. An integrated element 9 is on an inside of the main body 2A will then be designed with corresponding holes for reception of a screw, bolt or the like.

Each of the first and second end parts 2B, 2C is formed with an aperture 2F for reception and support of the inner hollow body 3 when the silencer 1 for shotgun is assembled. The second end part 2C is on an inside, when the silencer 1 for shotgun is assembled, formed with a circular flange 8, where the circular flange 8 is such arranged that it is aligned with the aperture 2F, so as to form an extension of the aperture 2F, on an inside of the second end part 2C. The circular flange 8 will further, over at least a portion of its length, have an inner diameter substantially corresponding to an outer diameter of the inner hollow body 3, and will be formed with an internal abutment shoulder 2H, so that the inner hollow body 3 can be received and supported by the flange 8 and the abutment shoulder 2H when the silencer 1 for shotgun is assembled. A threaded portion 6 is formed around an inner periphery of the aperture 2F, such that the silencer 1 for a shotgun can be connected to a barrel L of a shotgun (not shown), where an end termination of the barrel L then will be formed with a corresponding threaded portion (not shown).

The first end part 2B will, on an inside of the aperture 2F, be formed with an annular groove 21 for reception of a sealing element, for example an O-ring or the like, such that it is provided a seal between the inner hollow body 2 and the aperture 2F when the silencer 1 for a shotgun is assembled.

In order to provide a seal between the main part 2A and the first and second end parts 2B, 2C, a groove 2J is formed around an outer periphery of each of the first and second end parts 2B, 2C, such that a seal member, for example an O-ring or the like, can be arranged in the groove 2J. The sealing element will then provide a tight connection between the main part 2A and the first and second end parts 2B, 2C when the silencer 1 for a shotgun is assembled.

The first and second end parts 2B, 2C are furthermore provided with an abutment shoulder 5 for supporting the main body 2A when the silencer 1 for a shotgun is assembled.

Inside the outer housing 2 there is furthermore provided a number of spaced apart elements 2D, where each element 2D is designed with a throughgoing hole 2E for lead-through and support of the inner hollow body 3 when the silencer 1 according to the present invention is assembled.

The elements 2D are formed with a vertically extending portion extending a certain distance downwardly in the outer housing 2 and a horizontally extending portion extending in the longitudinal direction of the outer housing 2. The vertical portion of each element 2D will extend from an upper end of the outer housing 2 and to a length that is more than half of the height of the outer housing 2, while the horizontally extending portion of each element 2D will extend from element 2D to element 2D.

Through the above indicated construction and arrangement of the elements 2D, the horizontally extending portions of the elements 2D will form two separate, horizontal chambers in the outer housing 2; a first, upper chamber in which the inner hollow body 3 is arranged in, and a second, lower chamber. The first upper chamber and the second lower chamber are in communication with each other through a plurality of recesses formed in each of the horizontally extending portions of the elements 2D, such that exhaust gases from the first, upper chamber after a time, when the shotgun cartridge is fired, can escape to the second, lower chamber through the recesses in the horizontally extending portions of the elements 2D.

The vertically extending portions of the elements 2D will form tight, vertical chambers between two adjacent elements 2D.

Figure 3:
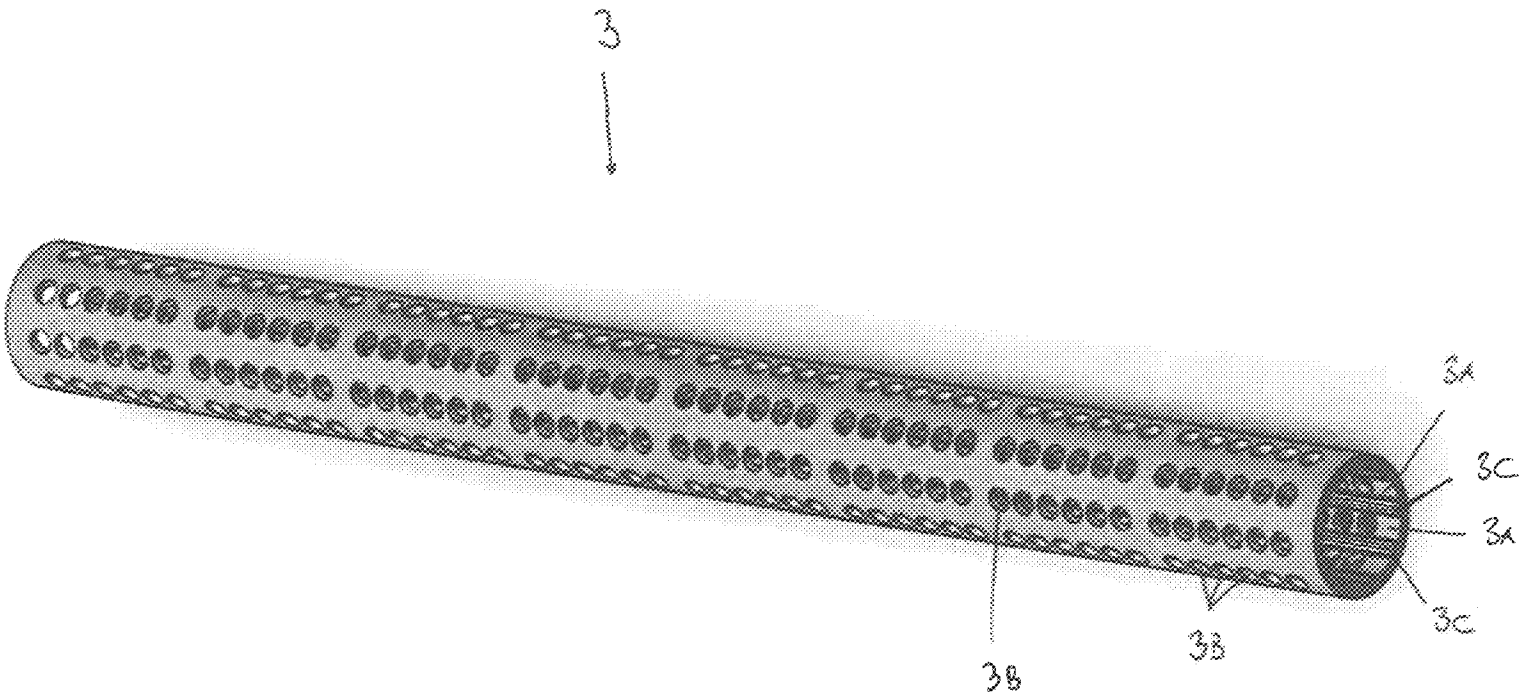
FIG. 3 shows an inner body of the silencer according to the present invention.

As it appears from FIG. 3, the inner hollow body 3 is formed with a throughgoing axial bore, and is, around an inner circumference of the axial bore, formed with a number of longitudinal recesses 3A and elevations 3C, where the longitudinal recesses 3A and the elevations 3C extend over the entire length of the inner hollow body 3. The longitudinal recesses 3A are furthermore arranged at a distance from each other, where the distance between two adjacent or subsequent longitudinal recesses 3A is equal, similarly as the elevations 3C are arranged at a distance from each other.

The number of longitudinal recesses 3A and elevations 3C the inner hollow body 3 is provided with, is preferably an odd number, such that the inner hollow body 3 is preferably formed with 3, 5, 7, 9 etc. longitudinal recesses and 3, 5, 7, 9 etc. elevations 3C.

Between two adjacent longitudinal elevations 3C it is furthermore, over the entire length of the inner hollow body 3, and in the recesses 3A, provided a plurality of throughgoing openings 3B arranged at a distance from each other. The spaced apart throughgoing openings 3B may be arranged with an equal distance between them, as shown in FIG. 1, or they may be grouped, as shown in FIG. 3. In FIG. 3 is seen that six throughgoing openings 3B are arranged in each group, and it is furthermore shown that six groups are formed over the inner hollow body's 3 length, where the distance between each group is equal.

The above number of throughgoing openings 3B in each group and the number of groups is merely meant as an example to illustrate a possible embodiment of the silencer 1 for a shotgun, whereby a person with skill in the art will know that the inner hollow body 3 can be formed with a different number of throughgoing holes, number of throughgoing holes in each group and number of groups.

The throughgoing openings 3B formed in the inner hollow body 3 are shown with a rectangular shape with rounded edges, but it is to be understood that the throughgoing openings 3B may also have other shapes, for example a circular, an oval, a polygonal or a square form. Furthermore, it should be understood that although the throughgoing openings 3B are shown to be of equal size, it should be understood that the throughgoing openings 3B may be formed with different sizes, such as increasing or decreasing size over the length of the inner hollow body 3, such that the inner cavity body 3 is formed with the smallest/largest openings at one end and where the throughgoing openings 3B increase/decrease successively toward the other end of the inner hollow body 3.

Figure 2:
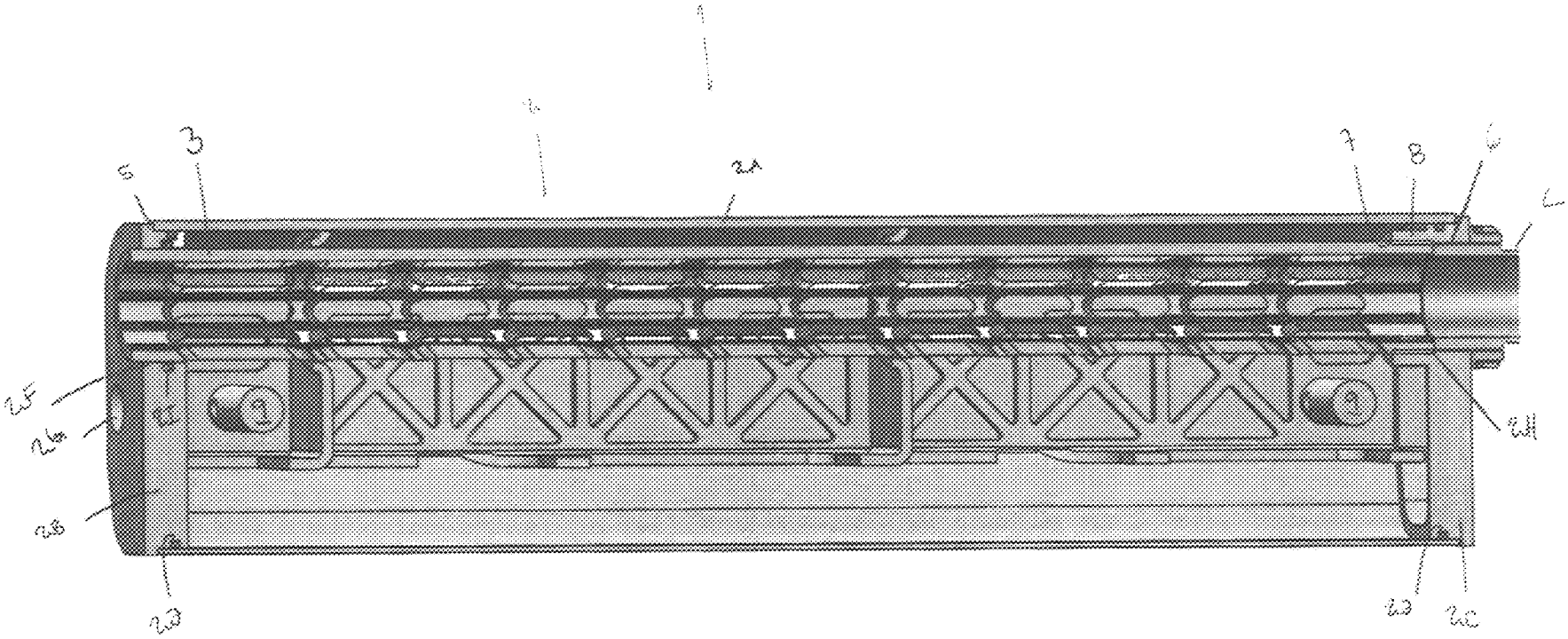
FIG. 2 shows a cross section through the silencer according to FIG. 1.

FIG. 2 shows a cross-section through an assembled silencer 1, which shows that the silencer 1 is connected to the barrel L of a shotgun (not shown) through the threaded portion 6 formed in the aperture 2F in the second end part 2C, and where the inner hollow body 3 is received and supported by the circular flange 8, whereby there is provided a flushing connection between the ends of the inner hollow body 3 and the barrel L of the shotgun.

Figure 4:
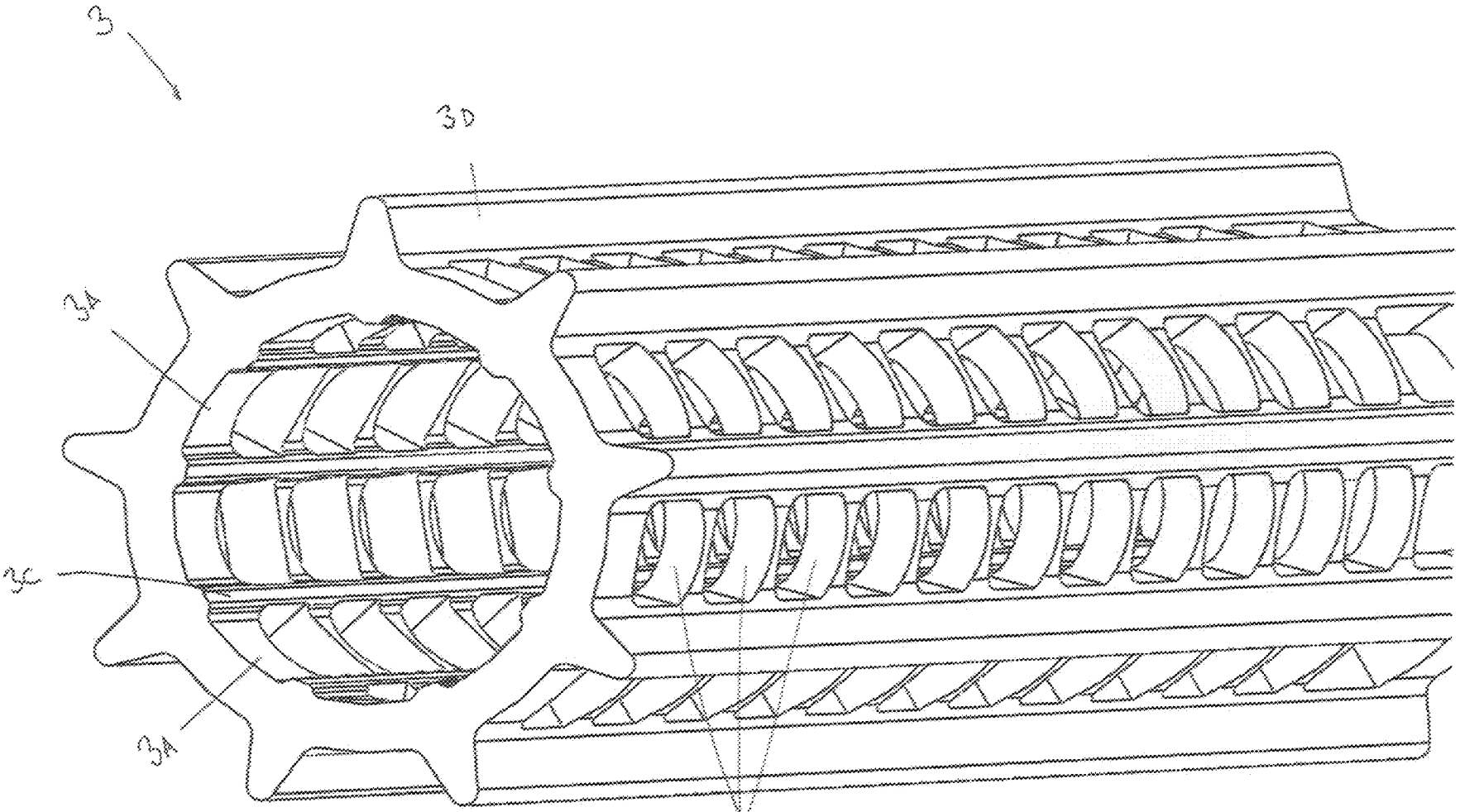
FIG. 4 shows an alternative embodiment of the inner body according to FIG. 3.

FIG. 4 shows an alternative embodiment of the inner hollow body 3 according to FIG. 3, in which the inner hollow body 3 in a similar manner as explained with respect to FIG. 3 is formed with a plurality of longitudinal recesses 3A and elevations 3C over the length of the inner hollow body 3 and around an inner circumference of the axial throughgoing bore.

The longitudinal recesses 3A and the elevations 3V are further arranged at a distance from each other, where the distance between two adjacent or subsequent longitudinal recesses 3A and the distance between two adjacent or subsequent elevations 3C is equal.

The number of longitudinal recesses 3A and elevations 3C the inner hollow body 3 is formed with, is preferably an odd number such that the inner hollow body 3 is preferably formed with 3, 5, 7, 9 etc. longitudinal recesses and 3, 5, 7, 9 etc elevations 3C.

Between two adjacent longitudinal elevations 3C, in the recess 3A, over the entire length of the inner hollow body 3, a plurality of spaced apart openings 3B are formed. The spaced apart openings 3B may be spaced with an equal distance between them, as shown in the figure, or they may be grouped as shown in FIG. 3. In FIG. 3 is seen that six throughgoing openings 3B are arranged in each group, and further six groups are formed over the length of the inner hollow body 3, where the distance between each group is equal.

The above number of throughgoing openings 3B in each group and the number of groups is merely meant as an example to illustrate a possible embodiment of the silencer 1 for a shotgun, whereby a person skilled in the art will know that the inner hollow body 3 can be formed with a different number of throughgoing holes, number of throughgoing holes in each group and number of groups.

The throughgoing openings 3B formed in the inner hollow body 3 are shown with a rectangular shape with rounded edges, but it should be understood that the throughgoing openings 3B also may have other shapes, for example circular, oval, polygonal or a square form. Furthermore, it should be understood that even if the throughgoing openings 3B are shown to be formed with equal size, it should be understood that the throughgoing openings 3B may be formed with different size, for example increasing or decreasing size over the length of the inner hollow body 3, such that the inner hollow body 3 is formed with the smallest/largest openings at one end and where the throughgoing openings increase/decrease successively towards the other end of the inner hollow body 3.

The inner hollow body 3 is further around an outer periphery provided with a plurality of longitudinal elevations 3D, where the longitudinal outer elevations 3D are arranged to be in line with the longitudinal inner elevations 3C.

Such a design of the inner hollow body 3 will provide a stronger structure of the inner hollow body 3, such that the inner hollow body 3 may be subjected to greater loads, for example if a plastic cup and/or shots in the shotgun shell should hit the throughgoing bore.

The inner hollow body 3 may be manufactured by extrusion and/or machining.

Figure 5:
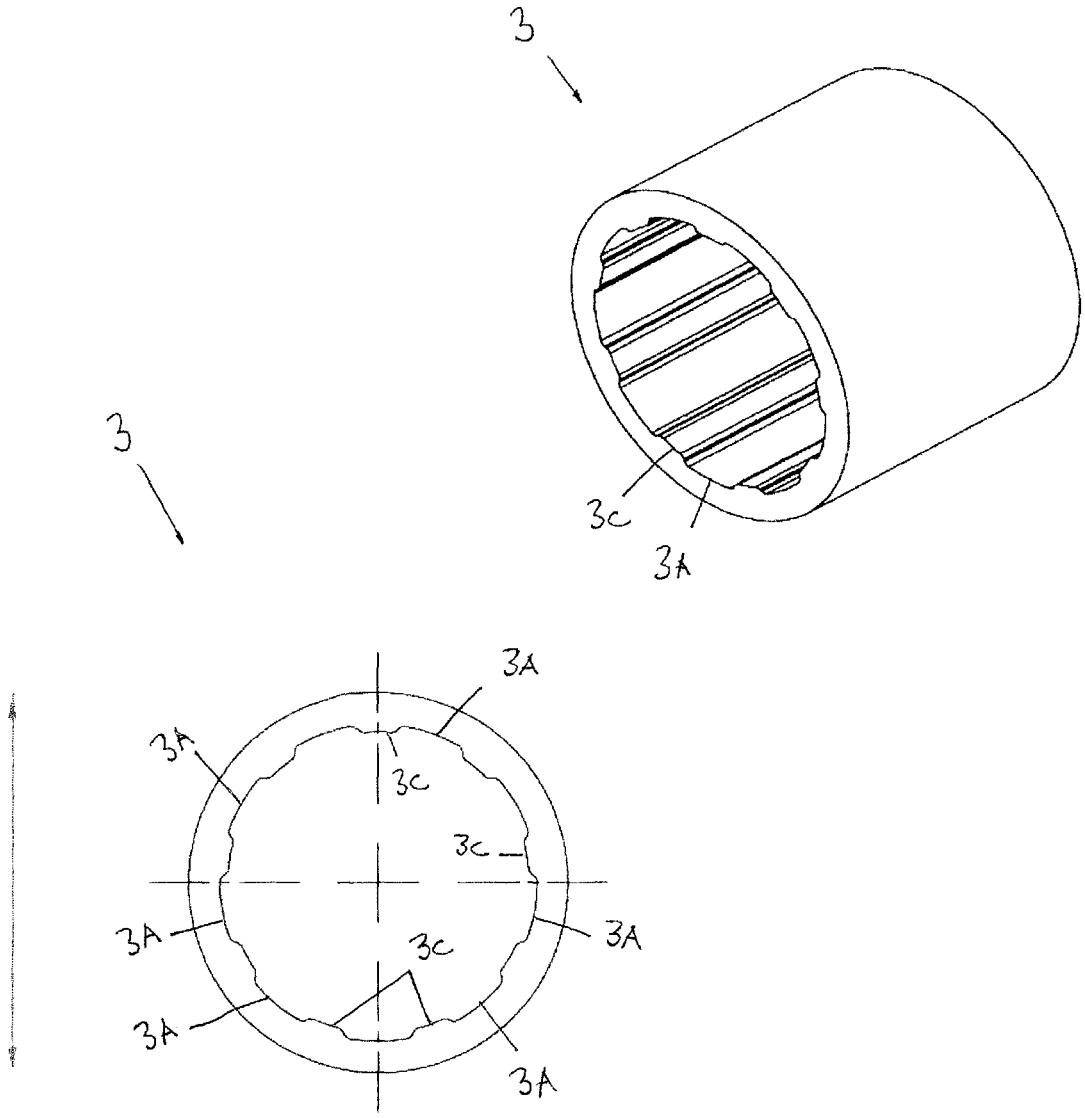
FIG. 5 shows a part of the inner body according to FIG. 3 in greater detail, seen from a front view and in a perspective view.

FIG. 5 shows the inner hollow body 3 from the front and in a perspective view, where the longitudinal recesses 3A and the elevations 3C are shown in greater detail.

Through the longitudinal elevations 3C, the shots, the plastic cup or felt plug from the shotgun shell can be held more together through the silencer 1, thereby achieving a better damping of noise and where the charge of shot will be more stable.

The present invention has now been explained with reference to different embodiments, but a person with skill in the art will appreciate that changes and modifications may be made to these embodiments which fall within the scope of the invention as defined in the appended claims.

The invention claimed is:

1. A silencer for a shotgun comprising an outer housing and an inner hollow body arranged in the outer housing, where the outer housing comprises a main part and a first and second end part connected to the main part, characterized in that the inner body is provided with a plurality of longitudinal elevations extending over a length of the inner hollow body and arranged spaced apart around an inner circumference of the inner hollow body, wherein a plurality of spaced throughgoing openings are provided between two adjacent longitudinal elevations over the length of the inner hollow body.

2. Silencer according to claim 1, characterized in that a number of spaced apart elements are provided on an inside of the outer housing, where each element is formed with a throughgoing hole for lead-through and support of the inner hollow body.

3. A silencer according to claim 2, characterized in that each element comprises a vertically extending part and a horizontally extending part, where the horizontally extending part is formed with one or more recesses.

4. A silencer according to claim 1, characterized in that the throughgoing openings are provided at the same or different distance from one another, or are grouped within a group of a plurality of groups, where two adjacent groups are arranged at a distance from each other.

5. A silencer according to claim 1, characterized in that the first end part is formed with a throughgoing hole for reception and support of the inner hollow body and the second end part is formed with an abutment shoulder for support of the main part.

6. A silencer according to claim 5, characterized in that the throughgoing hole for reception and support of the inner hollow body formed in the second end part is provided with a threaded portion.

7. A silencer according to claim 1, characterized in that the inner hollow body at one end is formed with an abutment shoulder for reception and support of a flange formed on the second end part.

8. A silencer according to claim 1, characterized in that the main part and/or the first and second end part of the outer housing are made of composite materials.

9. A silencer according to claim 1, characterized in that the throughgoing openings provided between two adjacent longitudinal elevations have a circular, oval, polygonal or square shape.

10. A silencer according to claim 1, characterized in that a number of longitudinal elevations are provided around an outer circumference of the inner hollow body.

* * * * *